US007298245B1

(12) United States Patent
VanHoose

(10) Patent No.: US 7,298,245 B1
(45) Date of Patent: Nov. 20, 2007

(54) EMERGENCY LIGHT

(76) Inventor: Harold D. VanHoose, 3739 Winward Lakes Dr., Tampa, FL (US) 22611

( * ) Notice: Subject to any disclaimer, the term of this patent is extended or adjusted under 35 U.S.C. 154(b) by 260 days.

(21) Appl. No.: 11/260,040

(22) Filed: Oct. 26, 2005

(51) Int. Cl.
*G08B 5/00* (2006.01)

(52) U.S. Cl. ..... 340/331; 340/321; 340/458; 340/815.4; 340/815.45; 362/72; 362/240; 362/500; 362/546

(58) Field of Classification Search ..... 340/331, 340/332, 321, 458, 815.4, 815.45; 362/72, 362/157, 240, 251, 362, 500, 545, 546
See application file for complete search history.

(56) References Cited

U.S. PATENT DOCUMENTS 4,613,847 A * 9/1986 Scolari et al. ..... 340/473
6,265,984 B1 * 7/2001 Molinaroli ..... 340/815.4
6,953,260 B1 * 10/2005 Allen ..... 362/194
7,158,020 B2 * 1/2007 Grady, Jr. ..... 340/473

* cited by examiner

*Primary Examiner*—Hung Nguyen
(74) *Attorney, Agent, or Firm*—Richard K Thomson

(57) ABSTRACT

An emergency light includes a flash light lamp and a plurality of LED lamps activated in strobe-like fashion to alert emergency personnel in transit the proper household needing their assistance. The LED lamps activated in excess of 120 times per minute is visible at distances in excess of one mile. The emergency light may be mounted to a window pane using suction cups, to a steel door or other ferrous-metallic surface using magnetic strips, hung on a door using an integral hanger or stood on a flat bottom surface.

7 Claims, 4 Drawing Sheets

EMERGENCY LIGHT

BACKGROUND AND SUMMARY OF THE INVENTION

The present invention is directed to the field of emergency lighting. More particularly, the present invention is directed to a light that can be readily attached to a residence or vehicle to enable emergency medical and rescue teams to more easily identify the point of need.

In medical emergencies, seconds can literally mean the difference between life and death; between being able to restore a patient to full health and merely extending the quantity of life at the expense of quality. One of the most problematic issues for emergency medical personnel is identifying the residence where the patient is located following a 911 call. Locating the residence is particularly difficult at night when house numbers and distinguishing characteristics of the home are obscured.

The present emergency light has a plurality of LED lamps which are connected in series to flash in strobe-like fashion at in excess of 120 times a minute. At night, the light can be detected from as far away as one mile enabling the emergency team to easily identify the residence, facilitating rapid access to and treatment of the patient. A plurality of mounting means are provided enabling the emergency light to 1) be secured to a window pane using suction cups attached to the front face of the light; 2) magnetically be attached to a steel door and to a portion of a motor vehicle using magnets on the rear of the light body; 3) hung over the top of a door or on a door handle using a hanger attached to an upper portion of the emergency light; and, 4) stood by means of a flat bottom on any available surface. The emergency light further has a flash light positioned on a second portion of the front face should existing conditions warrant.

Other features, advantages, and characteristics ofthe present invention will become apparent after a reading of the following detailed description of the preferred embodiments.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
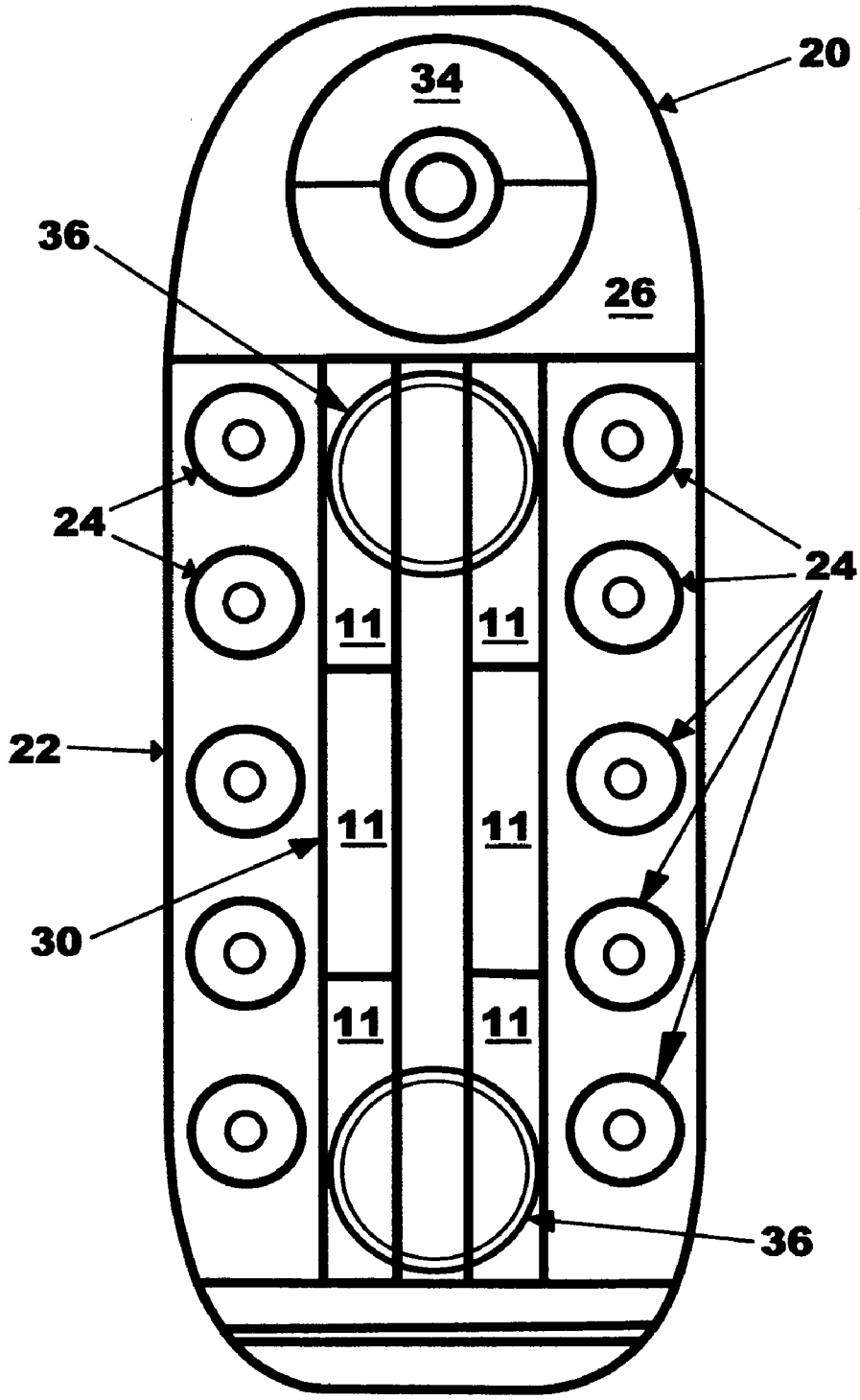
FIG. 1 is a front view of a first embodiment of the emergency light of the present invention.
Figure 2:
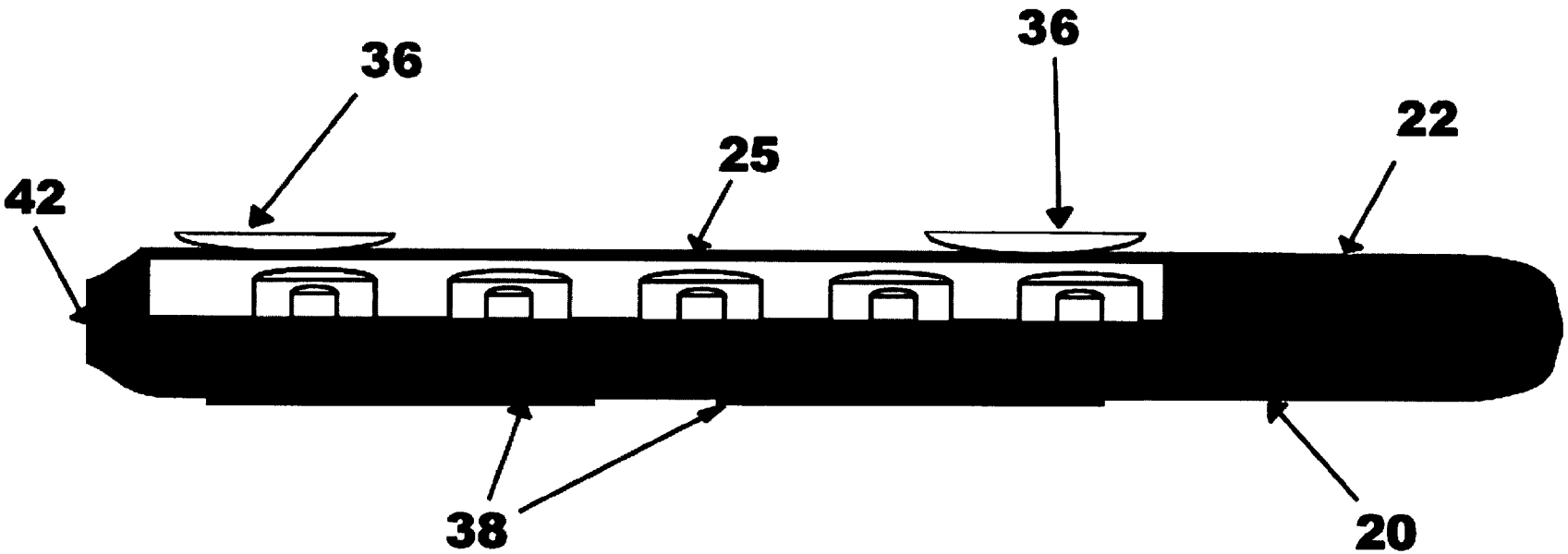
FIG. 2 is a side view of the first embodiment.
Figure 3:
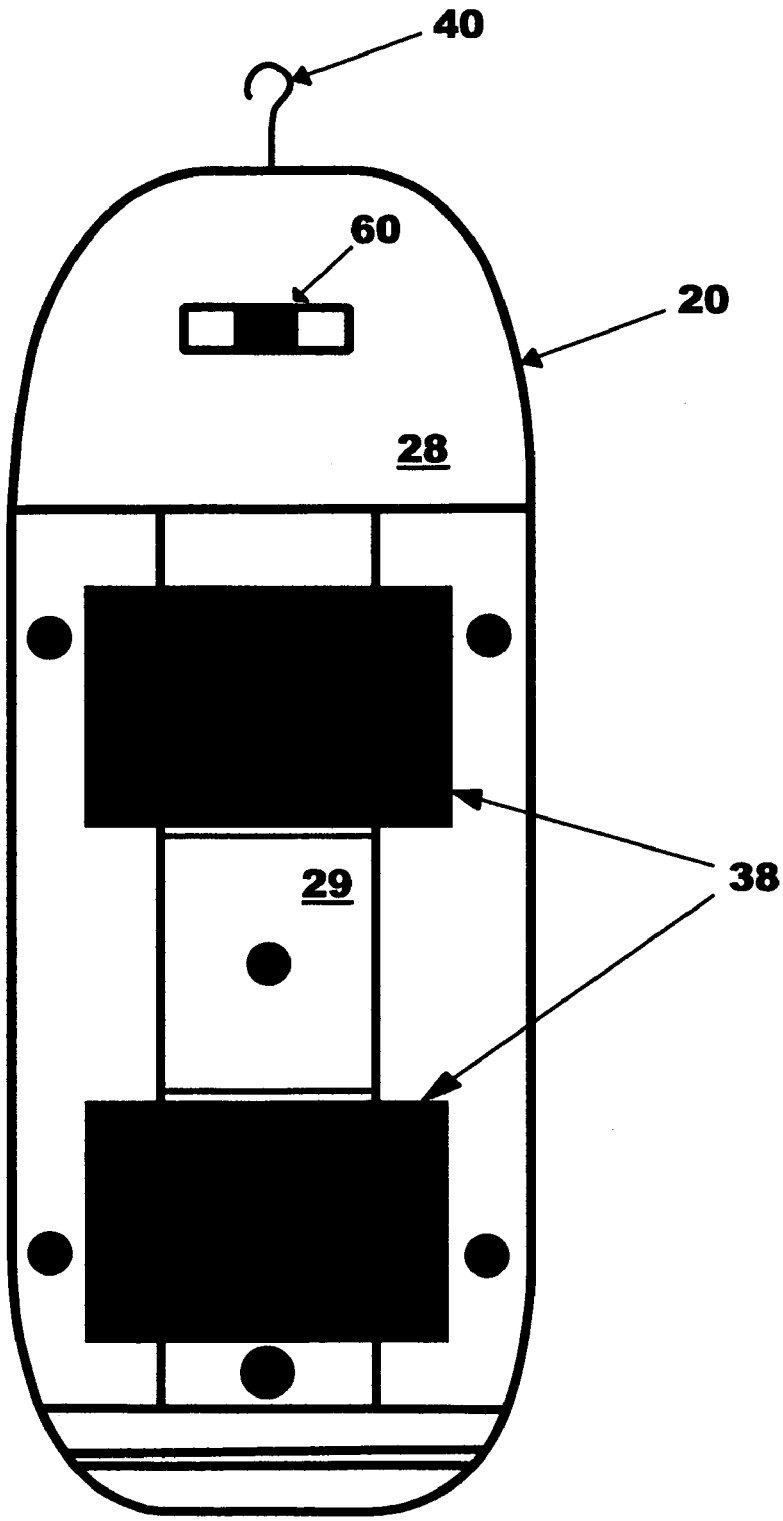
FIG. 3 is a rear view of the first embodiment.

A first embodiment of the emergency light of the present invention is depicted in FIGS. 1-3 generally at 20. This light has a generally rectangular body 22 with a plurality of LED lamps 24 mounted on front face 26. While ten lamps 24 have been depicted in FIG. 1, it will be appreciated that other numbers could be used without departing from the scope ofthe invention. In fact, a smaller version featuring only six lamps 24 (and four batteries) is contemplated for applications, such as automotive, requiring more compact lights 20. A battery pack 30, depicted here as comprising six AA batteries 11, provide power to operate the emergency light 20. Access to change the batteries will preferably be through a panel 29 in the rear face 28. A plastic cover 25 (FIG. 2) is preferably transparent or translucent and may be tinted amber, red or blue.

A single white lamp 34 is positioned on a second portion of front face 26 and functions as a flashlight in case of a power outage or when used in vehicular applications. First mounting means in the form of clear suction cups 36 are secured to the front face. Suction cups 36 permit emergency light 20 to be secured to the inside of a window pane where it can be readily viewed from the street. A second mounting means in the form of a plurality (shown in FIG. 3 as two) magnetic plates 38 are secured to the rear face 28 of emergency light 20. Magnetic plates 38 permit emergency light to be hung on a ferrous-metallic surface such as the front of a steel door or mounted on the roof or hood of a car. A third mounting means in the form of a hangar hook 40 is secured to the upper portion of body portion 22. Hangar 40 permits the emergency light to be suspended on the front of a door by either securing it over the upper edge, as with a screen door, for example, or hung on a handle; in addition, hangar 40 can permit the emergency light 20 to be suspended beneath the hood of a car with the flashlight 34 illuminated as the owner attempts to remedy the "it's-not-running-right" blues. Finally the bottom 42 of the body portion 22 is preferably flat enabling the emergency light to stand on any flat surface should none of the remaining mounting techniques be adequate in a particular situation.

Figure 4:
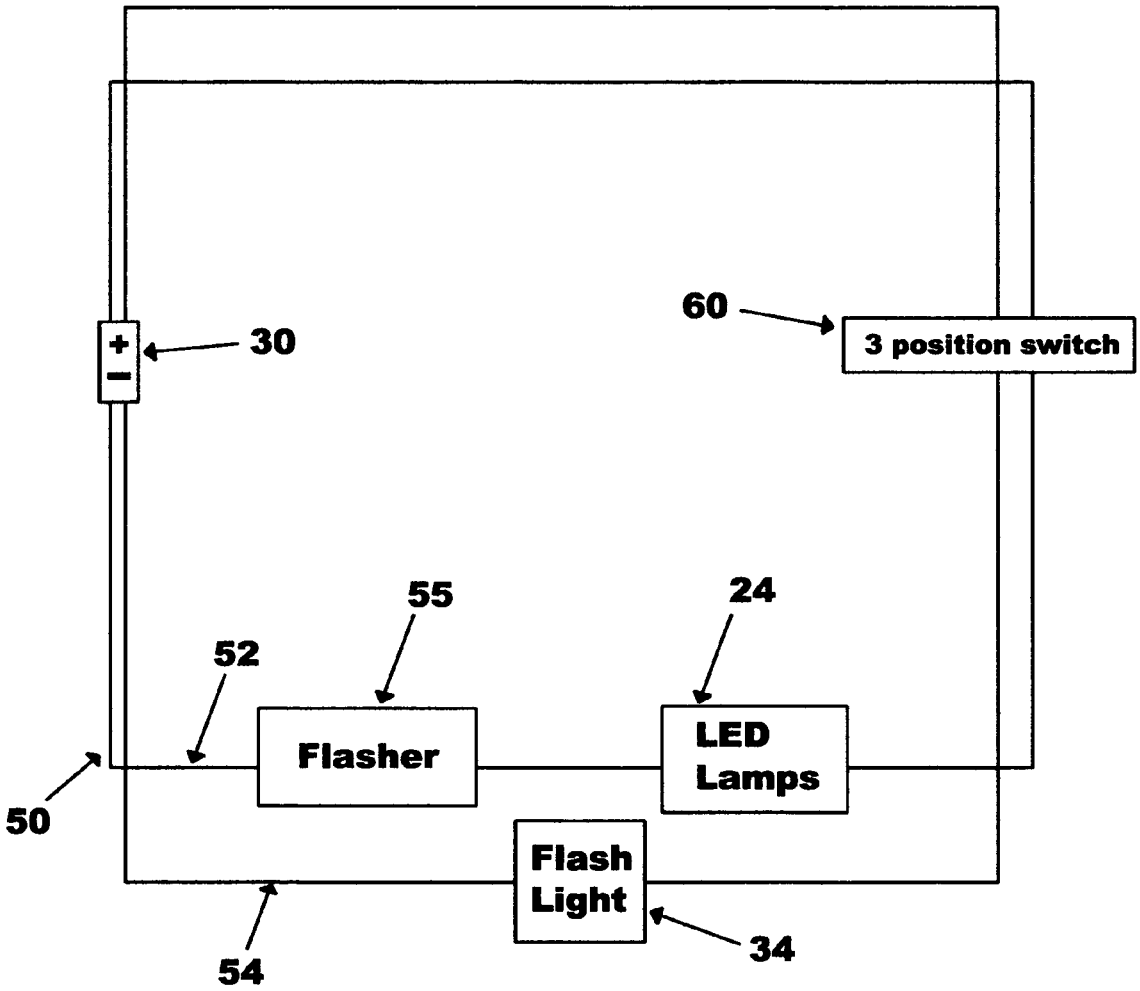
FIG. 4 is a schematic depiction of the electrical circuit used in the first embodiment.

A schematic electrical diagram is shown in FIG. 4 generally at 50. Battery pack 30 is wired by means of a first circuit 52 to LED lamps 24 and in parallel to flash light lamp 34 by a second circuit 54. Both circuits 52 and 54 are connected to 3-position switch 60 which is shown, by way of example and not limitation, as being positioned on the rear face 28 of body portion 22 (FIG. 3). Three position switch 60 includes a first off position; then a second position to illuminate LED lamps 24, actuated on a rotating basis by flasher 55; and, a third position for illuminating flash light lamp 34. Flasher 55 causes LED lamps 24 to flash at a rate exceeding 120 per minute, by way of example, 142 times per minute, this strobe-like flashing calling attention to the home or vehicle where it is mounted.

When 911 is called, the emergency team dispatcher can be informed that the emergency light 20 will be activated and clearly visible from the road. Then, while awaiting the team's arrival, emergency light 20 can be supported by whichever means desired to provide maximum visibility and permit ready identification of the household in need of attention. Alternatively, in the automotive application, both the flashlight lamp 34 and the LED lamps 24 can be of assistance to the owner of a disabled vehicle in identifying the problem and summoning assistance, respectively.

Various changes, alternatives and modifications will become apparent to one of ordinary skill in the art following a reading of the foregoing specification. By way of example, although 10 LED lamps are shown, one preferred embodiment having an overall length of only 5.5", has only 8 lamps which are powered by a single 9v battery. It is intended that any such changes, alternatives and modifications as fall within the scope of the appended claims be considered part of the present invention.

I claim:

1. An emergency light comprising a) a generally rectangular body portion;

b) a plurality of LED lamps connected in series on a portion of a front face of said body portion to flash strobe-as fashion in excess of a total of 120 times per minute;

c) a plastic cover enclosing said LED lamps;

d) a battery pack for powering said LED lamps;

e) first mounting means on said front surface for securing said emergency light to a window pane;

f) second mounting means for securing said emergency light to an alternative surface.

2. The emergency light of claim 1 wherein said plastic cover is made of a opaque material having a color selected from a group consisting of amber, red and blue.

3. The emergency light of claim 1 wherein said first mounting means comprises a plurality of suction cups attached to said front face of said body portion.

4. The emergency light of claim 1 further comprising a conventional white light mounted on a second portion of said front face operable as a flash light.

5. The emergency light of claim 1 wherein said second mounting means comprises a plurality of magnets enabling attachment a) to a steel door and b) to portion of a vehicle.

6. The emergency light of claim 5 further comprising a third mounting means comprising a hangar attached to an upper portion of said rectangular body portion by which said emergency light can be suspended.

7. The emergency light of claim 1 further comprising a flat bottom surface upon which said emergency light can stand.

* * * * *